US011174689B2

(12) United States Patent
Aguirre et al.

(10) Patent No.: US 11,174,689 B2
(45) Date of Patent: Nov. 16, 2021

(54) INTEGRATION OF MUD AND CEMENTING EQUIPMENT SYSTEMS

(71) Applicant: Schlumberger Technology Corporation, Sugar Land, TX (US)

(72) Inventors: Franz Aguirre, Sugar Land, TX (US); Andrew Marlatt, Houston, TX (US); John Allen Ray, Sugar Land, TX (US); David Gerard Gerber, Jr., Manvel, TX (US); Jagan Mohan Reddy Thaduri, Houston, TX (US); Seoyeon Hong, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 834 days.

(21) Appl. No.: 15/714,488

(22) Filed: Sep. 25, 2017

(65) Prior Publication Data

US 2019/0093433 A1 Mar. 28, 2019

(51) Int. Cl.

| | |
|---|---|
| ***E21B 21/01*** | (2006.01) |
| ***E21B 33/14*** | (2006.01) |
| ***E21B 21/06*** | (2006.01) |
| ***F04B 15/02*** | (2006.01) |
| ***F04B 49/06*** | (2006.01) |
| ***F04B 49/00*** | (2006.01) |
| ***F04B 23/06*** | (2006.01) |
| ***F04B 23/10*** | (2006.01) |
| ***F04B 23/04*** | (2006.01) |

(52) U.S. Cl.

CPC ..... *E21B 21/01* (2013.01); *E21B 21/062* (2013.01); *F04B 15/02* (2013.01); *F04B 23/04* (2013.01); *F04B 23/06* (2013.01); *F04B 23/10* (2013.01); *F04B 49/007* (2013.01); *F04B 49/065* (2013.01); *E21B 33/14* (2013.01)

(58) Field of Classification Search

CPC ..... E21B 21/01; E21B 21/062; F04B 23/04

See application file for complete search history.

(56) References Cited

U.S. PATENT DOCUMENTS

| | | | | |
|---|---|---|---|---|
| 2005/0121278 | A1 | 6/2005 | Arhab et al. | |
| 2007/0295509 | A1* | 12/2007 | Pessin | E21B 21/01 166/352 |
| 2010/0027371 | A1* | 2/2010 | Lucas | B01F 9/0003 366/134 |
| 2010/0310384 | A1 | 12/2010 | Stephenson et al. | |

(Continued)

FOREIGN PATENT DOCUMENTS

| | | | |
|---|---|---|---|
| CN | 106050215 | A | 10/2016 |
| WO | 03001062 | A1 | 1/2003 |
| WO | 20190173842 | A1 | 9/2019 |

*Primary Examiner* — Robert E Fuller
*Assistant Examiner* — Lamia Quaim

(57) ABSTRACT

A well operation facility including a first pump for delivering mud and cement to a borehole, a second pump for delivering mud to the borehole; a third pump for delivering the mud to the borehole, an inlet manifold coupled to each of the pumps for delivering the mud and/or cement to the pumps, and a discharge manifold coupled to each of the pumps for delivering the mud and/or cement at a pressure. In some embodiments, the first pump, the second pump, and the third pump are configured to be isolated from each other and to be used in series, parallel or as backups to each other.

21 Claims, 4 Drawing Sheets

(56) References Cited

U.S. PATENT DOCUMENTS

| | | | | |
|---|---|---|---|---|
| 2013/0118752 | A1* | 5/2013 | Hannegan | E21B 33/143 166/336 |
| 2016/0289012 | A1 | 10/2016 | Orban et al. | |
| 2017/0016433 | A1 | 1/2017 | Chong et al. | |
| 2017/0101827 | A1 | 4/2017 | Orban | |
| 2017/0198554 | A1* | 7/2017 | Dykstra | E21B 21/062 |
| 2017/0259457 | A1 | 9/2017 | Chong et al. | |
| 2017/0268323 | A1* | 9/2017 | Dykstra | E21B 33/06 |
| 2018/0258719 | A1 | 9/2018 | Orban et al. | |

* cited by examiner

INTEGRATION OF MUD AND CEMENTING EQUIPMENT SYSTEMS

Exploring, drilling, and completing hydrocarbon wells are generally complicated, time consuming and ultimately very expensive endeavors. This may be especially true in the case of certain drilling and completion operations where the configuration or environment of the operation or production site presents added challenges.

In certain drilling operations, the operating environment may pose several natural challenges dramatically affecting the expense of operations. In the case of land drilling, measures are often taken to curtail expenses such as keeping equipment and space for equipment to a minimum. That is, for a given land operation, any increase in the amount or types of equipment required, as well as the necessary accommodations, comes with a fairly dramatic increase in land set up and operating expenses. In certain circumstances expenses may be saved by limiting the equipment employed. However, even with certain sacrifices made in terms of equipment choices, redundancy and maximum equipment usage is desired in land operations.

Like most drilling rigs, a land rig generally includes both a mud pumping assembly and a cement pumping assembly along with a host of other drilling equipment. These assemblies, in particular, are alternatingly employed in completing an underground well and providing a casing therefor. That is, as a drill bit is advanced downward to form and extend a borehole below ground, the mud pumping assembly is employed to both provide fluid and remove debris with respect to a location near the advancing bit. Once the borehole has been drilled to the desired depth by the drill bit, mud circulation is temporarily stopped with the drill bit and associated drilling pipe brought back to the surface. A section of borehole casing may then be advanced down into the borehole. Once the borehole casing is properly positioned and the mud circulation terminated, the cement pumping assembly may be operated to pump a cement slurry through the borehole, securing the borehole casing in place. This process may then be repeated until a well of the desired depth has been completed. That is, further drilling, mud circulation, and advancing of additional borehole casing, may continue, periodically interrupted by subsequent cementing and securing of the casing as described.

Each system has had its equipment separately maintained and isolated given the potential catastrophic consequences of cement slurry or mud contamination at the improper stage of completion.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a well operation facility including a first pump for delivering mud and cement to a borehole, a second pump for delivering mud to the borehole; a third pump for delivering the mud to the borehole, an inlet manifold coupled to each of the pumps for delivering the mud and/or cement to the pumps, and a discharge manifold coupled to each of the pumps for delivering the mud and/or cement at a pressure. In some embodiments, the first pump, the second pump, and the third pump are configured to be isolated from each other and to be used in series, parallel or as backups to each other.

In another aspect, embodiments of the present disclosure relate to a method of delivering a fluid to a borehole. The method may include pumping one of mud or cement to the borehole through a pump at a first discharge pressure, circulating water through the pump to clean the first pump, and pumping the other of mud or cement to the borehole through the pump at a second discharge pressure.

In another aspect, embodiments of the present disclosure relate to a method of mixing and pumping a fluid into a well. The method may include controlling a flow of a fluid, the fluid being a mud fluid or a cement fluid, into the well by a single pump, sequentially performing said controlling step for the fluid so that the mud fluid and the cement fluid are sequentially placed in the well by the single pump.

In another aspect, embodiments of the present disclosure relate to a computerized control system for a drilling system that performs mud and cementing operations. The system may include communication equipment in communication with the pump system, processing equipment in communication with the communication equipment. In some embodiments, the processing equipment is configured to store the data of the pump system, configure a setup of the pump system, including mud operations and cementing operations, and switch the pump system between mud operations and cementing operations.

Figure 1:
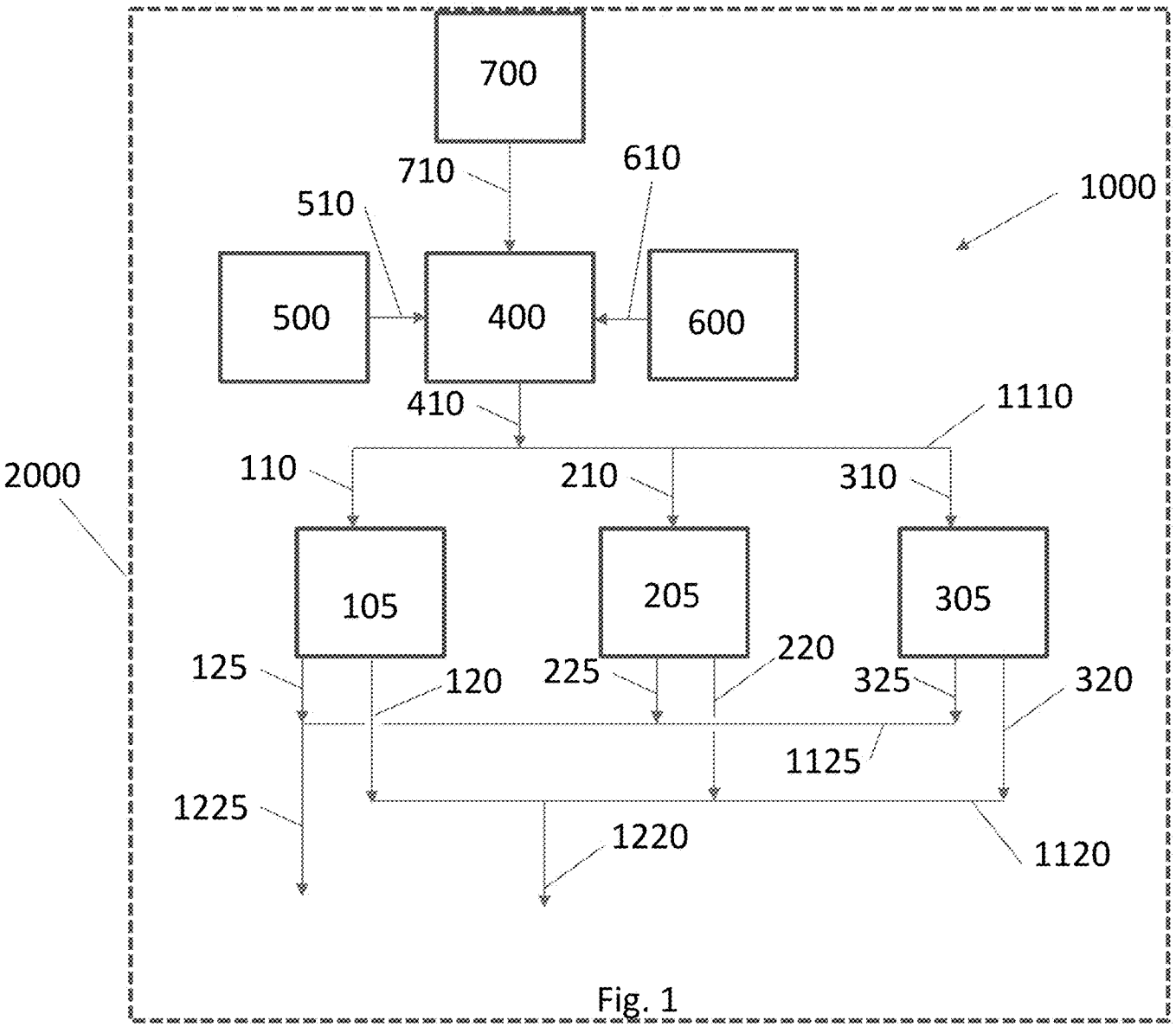
FIG. 1 illustrates a block diagram for a well operation process of delivering one or more fluids to a borehole, according to an embodiment.

It should be noted that some details of the figures have been simplified and are drawn to facilitate understanding of the embodiments rather than to maintain strict structural accuracy, detail and scale.

DETAILED DESCRIPTION

Reference will now be made in detail to embodiments of the present disclosure, examples of which are illustrated in the accompanying drawings. In the drawings and the following description, like reference numerals are used to designate like elements, where convenient. It will be appreciated that the following description is not intended to exhaustively show all examples, but is merely exemplary.

Embodiments of the present disclosure generally relate to providing an integrated metering and manifold platform system for supplying multiple pumps to supply either cement slurry or mud at a wellsite in an oilfield operation. In one or more embodiments, the multiple pumps may alternate between or sequentially pump mud and cement slurry. Also provided are embodiments of a method for operating the integrated metering and manifold platform system for supplying either cement slurry or mud at a wellsite in an oilfield operation.

As described, different types of fluid, including mud and cement slurry, may be present within (and pumped into) the borehole depending on what stage of the operation is in effect. However, these fluids serve entirely different purposes. The mud is circulated through the borehole with the purpose of lubricating, cooling, and furthering the advancement of the drill bit. On the other hand, cement is introduced to the borehole with the purpose of stabilizing the borehole casing in a secure and final position. Thus, the introduction of either of these fluids at the wrong time may be of dire consequence to the proper completion of the well. For example, the presence of no more than about 1%-3% mud at a location for cementing may prevent the cement slurry from setting and forming a proper bond between the borehole casing and the wall of the borehole at that location. On the other hand, cement contaminants within the mud during drilling may impede drilling and stop the advancement of borehole casing altogether. Either of these circumstances are likely to have severe consequences, perhaps requiring a shutdown of the entire operation for re-drilling at a new location, likely at a cost of several hundred thousand dollars if not more.

Given the potential catastrophic consequences of cement slurry or mud contamination at the improper stage of well completion, conventional mud pumping assemblies and the cement pumping assemblies are separately maintained and isolated from one another on the rig. Thus, the mud pumping assembly, operating 90%-97% of the time during active drilling operations, is operated from one location on the rig with multiple high horsepower prime movers, pumps and other equipment. When the time for cementing approaches, mud circulation is terminated and from a separate cementing room or location on the rig, the above described cement pumping assembly is operated, employing its own comparatively lower horsepower prime movers, pumps, and associated equipment. While understandable in light of the potential consequences of contamination as described above, this maintenance of entirely separate assemblies and associated equipment comes at a significant cost to already scarce footspace.

The integration of the mud and cement systems will provide equipment to mix and deliver both mud and cement downhole in a single system such that a single service provider for both operations and reduce the risk of contamination. In some embodiments, the integrated equipment may include high pressure pumps, a mixing system, a liquid additive system, a bulk storage system, and controls architecture, all of which may be utilized in both the mud and cement operations.

Referring now to FIG. 1, an integrated well operation facility 1000 includes a first pump 105, a second pump 205, and a third pump 305. The integrated well operation facility 1000 may also include a mixing system 400, a liquid additive system 500, and a bulk storage system 600. In some embodiments, the integrated well operation facility 1000 may also include a cleaning system 700.

The first pump 105, the second pump 205 and the third pump 305 may be integrated or coupled to each other and/or the mixing system 400, such that the first pump 105, the second pump 205 and the third pump 305 may be used with a cement slurry, a mud, or water. In some embodiments, equipment located in the integrated well operation facility 1000 may have power supplied by the rig of a land drilling operation. The first pump 105, the second pump 205 and the third pump 305 may be easily connected into the integrated well operation facility 1000, including piping, power and computer network.

In some embodiments, the first pump 105, the second pump 205 and the third pump 305 may be located on a cement mixer and multiple purpose pumper (CMMP) platform together. However, it is also envisioned that one or more pumps may be located a distance from one or more other pumps, such on a different skid and/or platform. In some embodiments, the first pump 105, the second pump 205 and the third pump 305 may be located on individual skids within the CMMP platform.

In still other embodiments, the mixing system 400, the liquid additive system 500, the bulk storage system 600 and the cleaning system 700 may be located on the CMMP platform, either all together or in any combination. The CMMP platform may be a mobile unit or a skid, both of which may be moved to various locations in a land drilling operation. By locating various combinations of the first pump 105, the second pump 205, the third pump 305, the mixing system 400, the liquid additive system 500, the bulk storage system 600 and the cleaning system 700 on mobile platforms, space and weight savings may reduce operational costs and provide other advantages to the well operation facility. In one or more embodiments, the mixing system 400, the liquid additive system 500, the bulk storage system 600 and the cleaning system 700 may be located on a separate trailer from the CMMP platform.

Continuing now with reference to FIG. 1, the first pump 105 and the second pump 205 may be used as a mud pump. In some embodiments, the first pump 105 and the second pump 205 may be a triplex pump. In other embodiments, the first pump 105 and the second pump 205 may be a quintuplex pump or any pump capable of providing the fluids at the desired properties. In some embodiments, the first pump 105 and the second pump 205 do not have to be the same type of pump. In some embodiments, the first pump 105 and the second pump 205 pump mud under high pressure into a bore hole as a primary responsibility or function. Mud, exiting under pressure from a bit, clears the cuttings and moves them out of the bore hole. The mud and cuttings may passed over a shale shaker which separates the cuttings from the mud and allows the mud to return to a mud tank for recirculation. The cuttings are sampled periodically for geologic purposes, but most are discarded. In some embodiments, the first pump 105 and the second pump 205 may be run in series. In other embodiments, the first pump 105 and the second pump 205 may be run in parallel.

The first pump 105 and the second pump 205 may be sized to operate at rates and pressures sufficient for mud operations and at rates and pressures sufficient to act as a primary mud pump. In one or more embodiments, the first pump 105 and the second pump 205 may be used as a primary mud pump and/or a backup cement pump. In other embodiments, the first pump 105 and the second pump 205 may be sized for a wide range of pumping, such as, but not limited to high flow rate, long duration, high pressure and low flow. In some embodiments, the first pump 105 and the second pump 205 may be equally sized and in other embodiments, they may be sized differently.

The third pump 305 may be a multi-purpose pump; it may be used as a cement pump or a mud pump. Specifically, it may function in both capacities or alternate between being used a mud pump and a cement pump for a given wellbore. In some embodiments, the third pump 305 may be a triplex pump. In other embodiments, the third pump 305 may be a quintuplex pump or any pump capable of providing the fluids at the desired properties. The third pump 305 may be sized to be equivalent to the first pump 105 and the second pump 205. In some embodiments, the third pump 305 may be a plunger or piston/liner pump. The third pump 305 may be sized to operate at rates and pressures sufficient for cementing operations and at rates and pressures sufficient to act as a back-up mud pump or a supplement mud pump in surface string operations. In some embodiments, the third pump 305 may be used as a primary cement pump, a primary mud pump for surface casing and/or a backup mud pump for intermediate and long string drilling. In other embodiments, the third pump 305 may be sized for a wide range of pumping, such as, but not limited to high flow rate, long duration, high pressure and low flow. In some embodiments, the third pump 305 may include a variable frequency drive located within the CMMP. In other embodiments, redundancy of the drives may be provided such that the third pump 305 may continuously operate. In some embodiments, the third pump 305 may be run in series with the first pump 105 and/or the second pump 205. In other embodiments, the third pump 305 may be run in parallel with the first pump 105 and the second pump 205.

In some embodiments, the first pump 105, the second pump 205 and the third pump 305 may be electrically driven by a power supply for the integrated well operation facility 1000, such as, but not limited to, a rig generator.

In some embodiments, the first pump 105 is coupled to an inlet 110 for receiving a plurality of fluids, a first outlet 120 for delivering a first fluid (such as mud) at a first pressure, and a second outlet 125 for delivering a second fluid (such as cement) at a second pressure. The inlet 110 may be coupled to an inlet manifold 1110. The first outlet 120 may be coupled to a first outlet manifold 1120 and the second outlet 125 may be coupled to a second outlet manifold 1125. The first outlet manifold 1120 delivers the first fluid to the borehole at the first pressure via line 1220. The second outlet manifold 1125 delivers the second fluid to the borehole at the second pressure via line 1225. Depending the type of fluid being pumped, the appropriate pressure may be selected, i.e., a higher pressure for mud and a lower pressure for cement.

While discussed with relation the fluids being mud and/or cement, other fluids used by the drilling process may also be pumped by the first pump 105, the second pump 205 and the third pump 305. For example, hole cleaning fluids such as spacers, washers or sweeps, loss circulation treatments, and displacement fluids, such as bines or completion fluids may be pumped using the integrated well operation facility 1000 equipment.

In some embodiments, the second pump 205 is coupled to an inlet 210 for receiving a plurality of fluids, a first outlet 220 for delivering the first fluid (such as mud) at the first pressure, and a second outlet 225 for delivering the second fluid (such as cement) at the second pressure, similar as described with respect to the first pump 105. The inlet 210 may be coupled to the inlet manifold 1110. The first outlet 220 may be coupled to the first outlet manifold 1120 and the second outlet 225 may be coupled to the second outlet manifold 1125. It is also envisioned that the second pump 205, if not operating as a cement backup pump, may not have a second outlet.

In some embodiments, the third pump 305 is coupled to an inlet 310 for receiving a plurality of fluids, a first outlet 320 for delivering the first fluid (such as mud) at the first pressure, and a second outlet 325 for delivering the second fluid (such as cement) at the second pressure, similar as described with respect to the first pump 105. The inlet 310 may be coupled to the inlet manifold 1110. The first outlet 320 may be coupled to the first outlet manifold 1120 and the second outlet 325 may be coupled to the second outlet manifold 1125. It is also envisioned that the third pump 305, if not operating as a cement backup pump, may not have a second outlet.

Through valving arrangements (not shown but appreciated by one of ordinary skill in the art), the inlets 110, 210, 310 may all be isolated from each other and the first pump 105, the second pump 205 and the third pump 305. In some embodiments, the inlets 110, 210, 310 may be, for example, a six-inch suction line, or particularly sized for the drilling operation. The inlet manifold 1110 may be sized for the wellbore operations (including both drilling and cementing).

Through valving arrangements (not shown but appreciated by one of ordinary skill in the art), the first outlets 120, 220, 320 may all be isolated from each other and the first pump 105, the second pump 205 and the third pump 305. In some embodiments, the first outlets 120, 220, 320 may be, for example, a three-inch discharge line, or particularly sized for the drilling operation. The first outlet manifold 1120 may be sized for the drilling operation.

Through valving arrangements (not shown but appreciated by one of ordinary skill in the art), the second outlets 125, 225, 325 may all be isolated from each other and the first pump 105, the second pump 205 and the third pump 305. In some embodiments, the second outlets 125, 225, 325 may be, for example, a three-inch discharge line, or particularly sized for the drilling operation. The second outlet manifold 1125 may be sized for the cementing operation, for example.

In some embodiments, the second outlets 125, 225, 325 and the second outlet manifold 1125 may be optional and the first outlets 120, 220, 320 and the first outlet manifold 1120 may be sized and rated to handle the first fluid at the first pressure and the second fluid at the second pressure.

In some embodiments, the inlet manifold 1110 is fed by a discharge 410 from the mixing assembly 400. The mixing assembly 400 may include equipment necessary to supply a cement slurry downhole, such as, but not limited to, a compressor, one or more cement silos, a surge can, a mixer, a mixing tub, an overflow tub and one or more pumps. The mixing assembly 400 may also include equipment necessary to supply a mud downhole, such as, but not limited to, mud storage, at least one mud tank, one or more pumps, one or more shale shakers, feed hoppers, mixers, etc. One of ordinary skill in the art would be able to design and size the various equipment to be located in the mixing assembly 400 for complete cementing and mud operations during drilling operations. In some embodiments, redundancy may be removed by having multi-purpose equipment within the mixing assembly 400 to be used in both the cementing and mud operations. In some embodiments, the mixing assembly 400 includes one or more mud pits.

The mixing assembly 400 may be fed by the liquid additive system 500 and the bulk storage system 600. In some embodiments, the mixing assembly 400 may also be fed by the cleaning system 700.

In some embodiments, the liquid additive system assembly 500 delivers liquid additives to the mixing assembly 400. The liquid additive system 500 includes equipment, known to one of ordinary skill in the art, for adding various liquid additives into a cement slurry, a mud slurry, or both. In some embodiments, the liquid additive system 500 may include one or more containers for storing one or more additives, a meter for moving a substance at a controlled rate, and a mixer for mixing a plurality of substances into a mixture. Furthermore, the additives may not be limited to gellants, but may include any additive used in the formulation of wellbore fluids, including cement and mud. In some embodiments, the liquid additive system 500 may be coupled to the mixing assembly 400 via the liquid discharge 510.

In some embodiments, the bulk storage system 600 delivers mud or cement or components thereof to the mixing assembly 400. The bulk storage system 600 may include a plurality of bulk storage silos which may be used interchangeably. In some embodiments, the bulk storage system 600 may be coupled to the mixing assembly 400 via the solid discharge 610.

In some embodiments, the cleaning system 700 is provided to circulate water (and/or cleaning solution) throughout the integrated well operation facility 1000. The water may be circulated from the cleaning system 700 through the first pump 105, the second pump 205, the third pump 305, the equipment located in the mixing assembly 400, and the bulk storage system, including all the piping and manifolds. The flow of water is used to clean the equipment located therein. In some embodiments, the cleaning system 700 may be coupled to the mixing assembly 400 via the water discharge 710.

In some embodiments, the integrated well operation facility 1000 may include a control unit 2000 for directing the well operation, including, but not limited to, mud pumping and cementing operations. Thus, a single operator may direct the fluids for well operations, including both drilling and cementing, from a single location at the integrated well operation facility 1000, thus efficiently streamlining operator interfacing with the first pump 105, the second pump 205, and the third pump 305 and all the equipment located in the integrated well operation facility 1000. In other embodiments, individual control units may be provided for one or more of the first pump 105, the second pump 205, the third pump 305, the mixing system 400, the liquid additive system 500, the bulk storage system 600 and the cleaning system 700. In some embodiments, the control unit 2000 may be located at the drilling site, at the terminals on the units, or may be located remotely, such as at the driller's cabin, with all locations having emergency stop capability. In some embodiments, the control unit 2000 may be integrated into the rig controls system. In some embodiments, the control unit 2000 may operate the equipment either manually or under automated control. In some embodiments, a single operator may direct well completion operations from a single location, thus efficiently streamlining operator interfacing with the integrated well operation facility 1000. In some embodiments, the control unit 2000 provides a command center which houses a master computer, communication equipment, and video monitors.

In some embodiments, the integrated well operation facility 1000 may include multiple subsystems which may provide for automatic control of water pressure, water rate, slurry density, recirculating slurry pressure, recirculating mud pressure, and downhole pump rate. The integrated well operation facility 1000 may be controlled locally or remotely for well operations from a local remote HMI. During operations, the integrated well operation facility 1000 may become active on an HMI screen for control. Each subsystem operates independently but in response to control from the control unit 2000. The first pump 105, the second pump 205 and the third pump 305 may include automatic combined and interrelated density and pumping control and selectable sequential control of predetermined mixing and pumping stages. At least as to the water rate control subsystem, the slurry density control subsystem, the mud density control system and the downhole pump rate control subsystem, the control unit 2000 generates control signals interrelated by set points entered by an operator through an HMI connected to the control unit 2000. The control unit 2000 also provides set point control signals to the water pressure, the recirculating mud pressure control subsystems and the recirculating slurry pressure control subsystems. The subsystems may function separately to simplify the control to single-input, single-output control loops that provide a more fault tolerant system.

In some embodiments, specific conditions which may be automatically controlled include water rate, water pressure, slurry density, recirculating slurry pressure and downhole pump rate. Each of these conditions may be the subject of a respective control loop that operates independently, but under control from control unit 2000. The control unit 2000 generates interrelated inlet water, inlet dry cement and outlet downhole pumping control signals responsive to operated-entered desired operating characteristics.

In some embodiments, the control unit 2000 may be used to automate and manage the flow of fluid between the mixing assembly 400, the first pump 105, the second pump 205 and the third pump 305 to the borehole and/or disposal. The control unit 2000 may allow for the full integration of cementing operations with the drilling rig operations. In some embodiments, an industrial network (such as Modbus TCP, Profibus, Profinet, etc.) with defined data arrangements may connect the cementing system network into the rig control network. The connection may be either a direct connection of through the use of one or more intermediate translation devices.

The integrated well operation facility 1000 may include various flowmeters, sensors, etc. such that the control unit 2000 may be programmed to manage the flow between the borehole and the first pump 105, the second pump 205 and the third pump 305 and changes between the operation of each. The control unit 2000 may also be programmed to identify equipment within the integrated well operation facility 1000. The control unit 2000 may also be programmed to isolate equipment within the integrated well operation facility 1000, such that contamination may be limited. The control unit 2000 may also be programmed to provide an automatic equipment cleaning cycle within integrated well operation facility 1000, and combinations thereof such that contamination may be limited.

In some embodiments, the inlet manifold 1110 may supply cement slurry from the mixing assembly 400 to any of the first pump 105, the second pump 205 and the third pump 305 via the first inlet 110, the second inlet 210, and the third inlet 310, respectively. The inlet manifold 1110 may supply water from the cleaning assembly 700 to any of the first pump 105, the second pump 205 and the third pump 305 via the first inlet 110, the second inlet 210, and the third inlet 310, respectively. The inlet manifold 1110 may supply mud from the mixing assembly 400 to any of the first pump 105, the second pump 205 and the third pump 305 via the first inlet 110, the second inlet 210, and the third inlet 310, respectively. In operation, any of the first pump 105, the second pump 205 and the third pump 305 may be used to pump (at different times) both mud and cement. Specifically, the top section of a well generally requires a greater number of pumps to pump mud therein during than later sections of the well. Thus, instead of having a mud pump being offline (not used) throughout the remainder of the drilling and completion operations, the present disclosure provides for a multi-purpose pump(s) that is configured to receive mud and cement and can be used to pump either, depending on the stage of the operation. The third pump 305 may be such a multi-purpose pump.

In some embodiments of operation, the first pump 105 and the second pump 205 may primarily serve to deliver mud downhole, while the third pump 305 may pump (at different times) both mud and cement into a given well; however, if the first pump 105 and the second pump 205 are pre-configured to also receive cement, then in the event of a breakdown of the third pump 305, the first pump 105 and/or the second pump 205 may be used to pump cement as well. While the first pump 105 and/or the second pump 205 may not generally be used as a multi-purpose pump, embodiments of the present disclosure may include the first pump 105 and/or the second pump 205 being configured to operate as such, if such need arises during well operations. The pipings achieving such configuration are described herein.

In some embodiments, the first outlet manifold 1120 may supply cement slurry from the first pump 105, the second pump 205 and the third pump 305 to the borehole at a first pressure via the line 1220. The first outlet manifold 1120 may supply water from the first pump 105, the second pump 205 and the third pump 305 for disposal. The second outlet manifold 1125 may supply mud from the first pump 105, the second pump 205 and the third pump 305 to the borehole at a second pressure via line 1225. It is understood that the first pressure and the second pressure may be different (specifically, in one or more embodiments, the first pressure (for cement) is lower than the second pressure (for mud)).

Flexibility in the integrated well operation facility 1000 may be found by having the third pump 305 being capable of being fed cement or mud from the mixing assembly 400 and being able to deliver either the cement or mud to the wellbore at two different pressures, depending on the fluid being pumped. The flexibility may also be achieved by having the first pump 105 and the second pump 205 being capable of being fed cement or mud from the mixing assembly 400 and being able to deliver either the cement or mud to the wellbore at two different pressures, depending on the fluid being pumped. Thus, the first pump 105, the second pump 205 and the third pump 305 may be used as redundancy/backup for each other. By having the cleaning assembly 700 provide water to the first pump 105, the second pump 205 and the third pump 305, the pumps may be cleaned to limit the risk of contamination between the pumps and associated equipment and piping. In some embodiments, the cleaning assembly 400 may also provide water to the mixing assembly 400, the liquid additive system 500, and the bulk storage system 600 provide water to all equipment located therein. Isolation between the first pump 105, the second pump 205 and the third pump 30, the mixing assembly 400, the liquid additive system 500, the bulk storage system 600, and the cleaning assembly 700 may be provided by numerous valves which may limit the risk of contamination between the assemblies.

The integrated well operation assembly 1000, specifically the ends of the electrical lines, hydraulic lines and/or pneumatic lines, and the equipment located therein may have plug-and-play connections, such as, for example but not limited to, those sold by Parker Hannifin Corp. (Minneapolis, Minn.) or Stucchi USA Inc., Romeoville, Ill. The plug-and-play connections may connect the electrical lines, the hydraulic lines and/or the pneumatic lines from the integrated well operation assembly 1000 to the first pump 105, the second pump 205, the third pump 305, the mixing assembly 400, the liquid additive system 500, the bulk storage system 600, and the cleaning assembly 700. A centralized engine located within the integral well operation assembly 1000 may supply power to the equipment located within the first pump 105, the second pump 205, the third pump 305, the mixing assembly 400, the liquid additive system 500, the bulk storage system 600, and the cleaning assembly 700. The plug-and-play connections may be integrated into the first pump 105, the second pump 205, the third pump 305, the mixing assembly 400, the liquid additive system 500, the bulk storage system 600, and the cleaning assembly 700 and the equipment located therein may be provided with universal terminals so that when plugged into each other, the terminals will make a proper connection, such as a power, a hydraulic or a pneumatic connection, between a central source, including a central electricity line, a central hydraulic line and/or a central pneumatic line, and the equipment.

Figure 2:
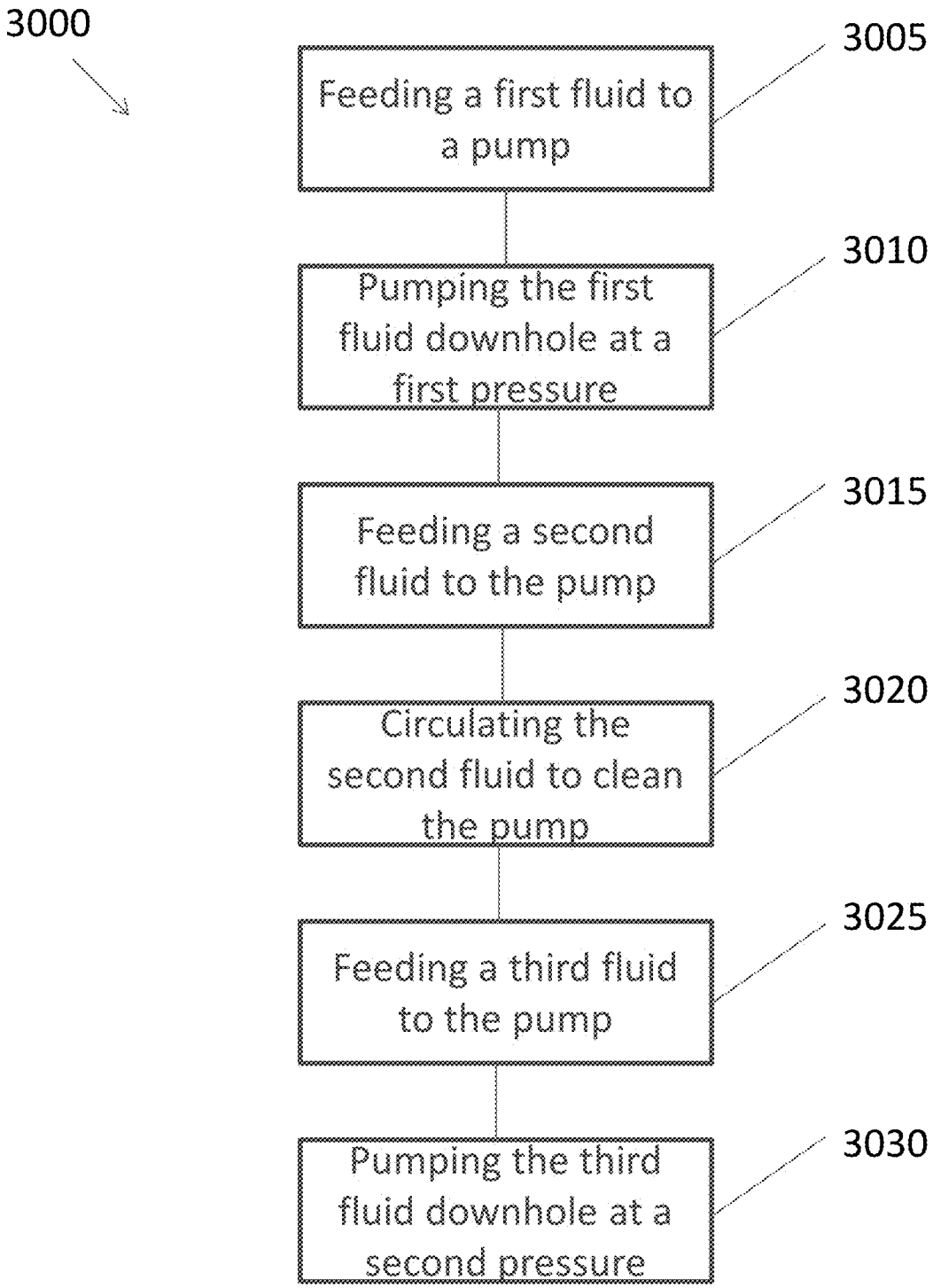
FIG. 2 illustrates a flow diagram for a well operation process of delivering one or more fluids to a borehole, according to an embodiment.

An embodiment of a well completion process 3000 using the integrated well operation facility 1000 is shown in FIG. 2. During drilling, mud may be pumped downhole by one or more of the first pump 105, the second pump 205, and the third pump 305. In some embodiments, the first pump 105 and the second pump 205 are sized to maintain consistent flow of mud downhole. The first pump 105, the second pump 205, and the third pump 305 have various pieces of equipment, including sensors and controllers, for monitoring the flow and composition of the mud being pumped downhole and also being returned for recycling. In some embodiments, redundancy may be provided by having the first pump 105, the second pump 205, and the third pump 305 so that if for some reason one of the pumps is unable to complete the drilling operation, the other pump(s) be put into operation to complete the drilling. Thus, the third pump 305 may have duality for pumping mud and/or cement, by being sized and piped to accommodate both wellbore fluids. In other embodiments, the first pump 105 and the second pump 205 may provide redundancy as a backup cement pump thereby providing duality for pumping mud and/or cement, by being sized and piped to accommodate both wellbore fluids.

In some embodiments, the third pump 305 may be called into service either as an additional mud pump or as a backup mud pump to the first pump 105 and the second pump 205. In some embodiments, the mud may be fed as a first fluid to any combination of the first pump 105, the second pump 205, and the third pump 305 in stage 3005 (which, in the initial drilling stage of the top section, all three pumps are used). To feed the mud to the first pump 105, the second pump 205, and the third pump 305, the mixing assembly 400, the liquid additive system 500, and the bulk storage system 600 may be used to mix the mud based on the demands of the drilling operation. Valving may be manipulated to ensure mud flows from the mixing assembly 400 to any of the first pump 105, the second pump 205, and the third pump 305 via the inlet manifold 1110. The first pump 105, the second pump 205, and the third pump 305 pressurizes the mud to a first pressure in stage 3010. Valving may also be manipulated to ensure mud flows from the first pump 105, the second pump 205, and the third pump 305 to the borehole via the first outlet manifold 1120 and line 1220 at the first pressure. The first pressure typically ranges from about 3000 kPa to about 50000 kPa, or from about 3400 kPa to about 49000 kPa.

When it is determined to stop the mud flow via the inlet manifold 1110 to the first pump 105, the second pump 205, and the third pump 305, the first pump 105, the second pump 205, and the third pump 305 may be isolated from the mixing assembly 400. Valving may be manipulated to ensure water, as a second fluid, may flow from the cleaning assembly 700 via water inlet 710 to the mixing assembly 400, the liquid additive system 500, the bulk storage system and the first pump 105, the second pump 205, and the third pump 305 in stage 3015. Water may then be circulated throughout the piping and the first pump 105, the second pump 205, and the third pump 305 to clean the multi—the first pump 105, the second pump 205, and the third pump 305 and associated equipment in stage 3020. The circulation may be manipulated through valving to ensure water may flow from the first pump 105, the second pump 205, and the third pump 305 to disposal facilities.

In some embodiments to complete the well, cement may be pumped via one or any combination of the first pump 105, the second pump 205, and the third pump 305. The cement may be fed as a third fluid to the first pump 105, the second pump 205, and the third pump 305 in stage 3025. To feed the cement to the first pump 105, the second pump 205, and the third pump 305, the mixing assembly 400, the liquid additive system 500, and the bulk storage system 600 may be used to mix the cement based on the demands of the drilling operation. Valving may be manipulated to ensure mud flows from the mixing assembly 400 to any of the first pump 105, the second pump 205, and the third pump 305 via the inlet manifold 1110. The first pump 105, the second pump 205, and the third pump 305 pressurizes the cement to a second pressure in stage 3030. Valving may also be manipulated to ensure cement flows from the first pump 105, the second pump 205, and the third pump 305 from the second outlet manifold 1125 via line 1225 to the borehole at the second pressure. The second pressure typically ranges from about 3000 kPa to about 70000 kPa, or 3400 kPa to 69000 kPa.

Optionally, when it is determined to stop the cement flow, the first pump 105, the second pump 205, and the third pump 305 may be isolated from the mixing assembly 400. Valving may be manipulated to ensure water may flow from the cleaning assembly 700 via water inlet 710 to the first inlet 215, in a repeat of stage 3015. Water may then be circulated throughout the piping and multi-purpose pump 205 to clean the multi-purpose pump 205 and associated equipment, in a repeat of stage 3020. The circulation may be manipulated through valving to ensure water may flow from the multi-purpose pump 205 from the first outlet 235 to disposal facilities.

Drilling while employing circulating mud provides lubrication and a degree of cooling to a grinding bit. The circulation of the mud also allows for the removal of cuttings and debris as the borehole extends deeper below the floor. In some embodiments, the mud circulation and drilling are directed from control unit 2000. Once a given depth of the borehole has been reached, the control unit 2000 may be employed to cease the indicated circulation of mud and retract the drilling pipe. Thus, cementing of a section of borehole casing may ensue. The control unit 2000 may also be used in directing the subsequent cementing application. In some embodiments, the control unit 2000 may also control the operation of the mixing assembly 400, the liquid additive system 500 and the bulk storage system 600.

In some embodiments, the control unit 2000 is remote from the CMMP. In other embodiments, components of the control unit 2000 may be located on or near the CMMP. It is also envisioned that the control unit 2000 may include a plurality of HMIs, allowing for a user to operate the control unit, from a driller's chair or from the unit itself. For example, in some embodiments, such as during the mud operation, the driller may control the first pump 105, the second pump 205, and the third pump 305 from an HMI at the driller's chair. In other embodiments, a remote user may control the first pump 105, the second pump 205, and the third pump 305 during mud operations through the rig network. The control may be switched between the rig network and the driller. When transitioning from drilling to cementing, it is envisioned that because of the different personnel that may be involved with drilling and cementing, the control unit 2000 may be operated from an HMI terminal local to the CMMP unit. When a new user seeks access to the control unit 2000, the control unit 2000 may notify the prior user that control has been requested, and prompt the user to access or decline such access, where the system may also automatically switch access upon expiration of a certain period of time. Further, it is also envisioned that the HMIs may be prioritized so that one location may override the other. Thus, it is envisioned that when transitioning from drilling to cementing, control of the CMMP may be switched from the driller's chair to the unit terminal so that the cementing (including both mixing and pumping of the cement slurry) may be controlled by cementing personnel. Upon completion of cementing, control may return to the driller's chair. Further, it is also envisioned that pump operation during both drilling and cementing may be controlled from a single location, such as the driller's chair. Additionally, it is also envisioned that the control unit 2000 may be designed so that at any given time, only a single user is in control of operating the system.

The control unit 2000 may also collect data from a variety of sensors located throughout the integrated well operation facility 1000. Based on this data, the control 2000 may be used to control the mud pumping and the cementing operations. The data from the control unit 2000 may be transferred to a rig network. The data may include status (read only) tags, data tags and control tags. Further, it is also envisioned that the control unit or network may also include a spreadsheet, for example, to correlate the data into a usable and readable form, to inform the network of the form and type of data being transmitted.

In some embodiments, the control unit 2000 may control the operation of the mixing assembly 400, the liquid additive system 500 and the bulk storage system 600. Based on the data collected by the control unit, the control unit 2000 may modify the mud composition or the cement composition. The control unit 2000 may also control when the integrated well operation assembly 1000 switches from pumping mud to pumping cement. The control unit 2000 may also control the cleaning system 700 such that the integrated well operation assembly 1000 is cleaned when switching between mud and cement operations.

Figure 3:
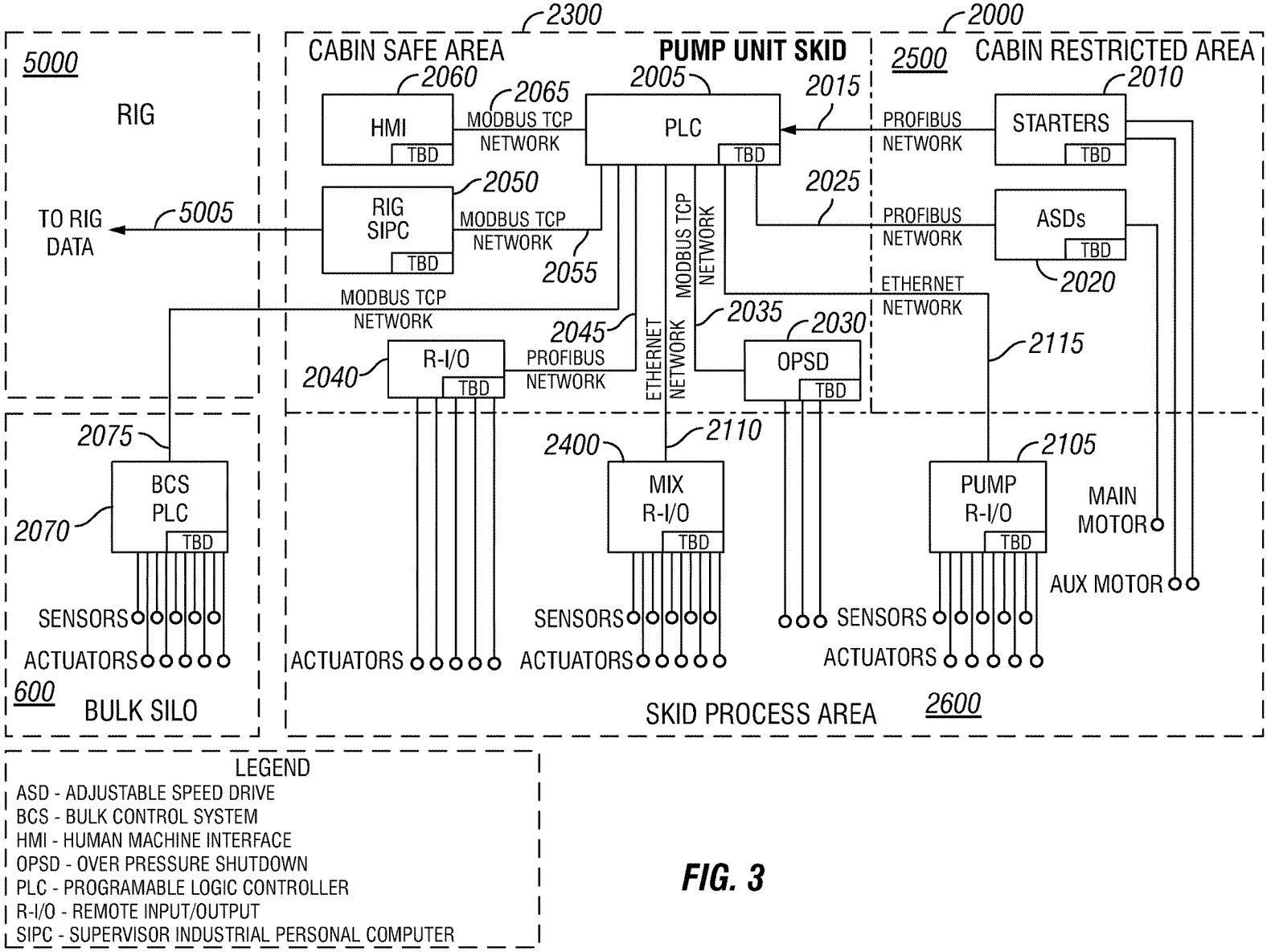
FIG. 3 illustrates a control system block diagram for a well operation process of delivering one or more fluids to a borehole via a second pump, according to an embodiment.

Referring to FIG. 3, an embodiment of a control system block diagram is shown. The control system 2000 may include a number of sub-systems, components, controllers, and interfaces to control and monitor the operations of the well operation facility 1000. A programmable logic controller (PLC) 2005 may be coupled to a mixing assembly remote input/output (R-I/O) 2400 and a pump assembly remote input/output (R-I/O) 2105 such as by an Ethernet network 2110 and 2115, respectively. One or more starters 2010 for the auxiliary motors may be connected to the PLC 2005 such as by a PROFIBUS network 2015. One or more adjustable speed drives 2020 for a main motor may be connected to the PLC 2005 such as by a PROFIBUS network 2020. An over pressure shut down (OPSD) system 2030 may be connected to the PLC 2005 such as by a MODBUS network 2035. A remote input/output (R-I/O) device 2040 may be connected to the PLC 2005 such as by a PROFIBUS network 2045. A rig supervisor industrial personal computer (SIPC) 2050 may be connected to the PLC 2005 such as by a MODBUS network 2055. The PLC 2005 may also be connected to a human machine interface (HMI) 2060 such as by a MODBUS network 2065. In some embodiments, the HMI 2060 may be local to the pumps, and control of the well operation facility 1000 may be done in an area proximate the pumps. In some embodiments, a bulk control system (BCS) programmable logic controller (PLC) 2070 may be connected to the PLC 2005 by a MODBUS network 2075. However, as mentioned above, it is also intended that in one or more embodiments, control of the wellbore operation facility 1000 may be performed from the driller's chair (not shown), which may occur via rig network 5000. In some embodiments, the PLCs & R-I/Os, may be interchangeable, meaning an R-I/O could be a PLC and a PLC could be an R-I/O. In some embodiments, the control system 2000 may also have the ability to add/remove equipment from the liquid additive system 500, the bulk control system 600, a lost circulation system, etc. In some embodiments, these pieces of equipment may be connected in similar fashion such as, for example but not limited to, ProfiNet, ProfiBus, Modbus TCP, CAN, etc.

In some embodiments, the PLC 2005, the OPSD 2030, the R-I/O 2040, the rig SIPC (2050) and the HMI (2060) may be located in a cabin safe area 2300 of a pump unit skid 2200. The cabin safe area may be located near a restricted area 2500 which may include the starters 2010 and the ASDs 2020, for example. In some embodiments, the BCS PLC 2075 may be located in or near the bulk storage system 600. The mixing assembly R-I/O 2400 and the pump assembly R-I/O 2105 may be located on a skid process area 2600. In some embodiments, the rig network 5000 may receive data from PLC 2005, and the PLC 2005 may the receive data from the rig network 5000, such as via a PROFIBUS network 5005. Such communication may be via the SIPC 2050. This provides an interaction between the rig network 5000 and the well operation facility 1000. As mentioned above, in some embodiments, the well operation facility 1000 may be controlled remotely, i.e., from the driller's cabin.

The system 2000 may interact between the sub-systems via data tags and may organize the data such that the computer may correlate the data of what is being sent to the well operation facility 1000 and what is being received. The data tags may include read only tags and control tags, for example.

In some embodiments, the well operation facility 1000 is fully integrated into a drilling rig network. In some embodiments, industrial networks (Modbus TCP, Profibus, Profinet, etc.) may use defined data arrangements to connect to the well operation facility 1000. In some embodiments, the connections may be direct connections or may be through one or more intermediate translation devices.

Figure 4:
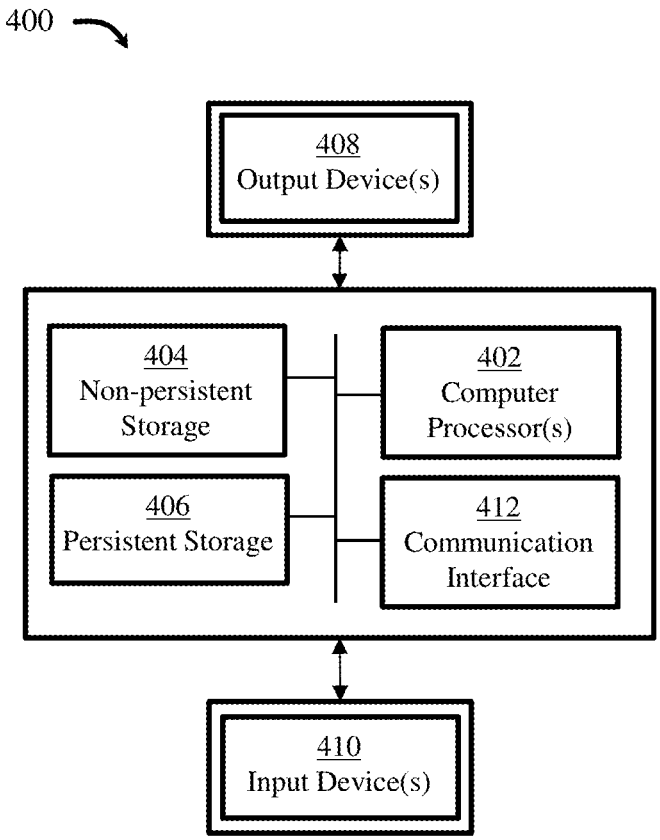
FIG. 4 illustrates a computing system block diagram for a well operation process of delivering one or more fluids to a borehole, according to an embodiment.

Embodiments may be implemented on a computing system. Any combination of mobile, desktop, server, router, switch, embedded device, or other types of hardware may be used. For example, as shown in FIG. 4, a computing system 400 may include one or more computer processors 402, non-persistent storage 404 (e.g., volatile memory, such as random access memory (RAM), cache memory), persistent storage 406 (e.g., a hard disk, an optical drive such as a compact disk (CD) drive or digital versatile disk (DVD) drive, a flash memory, etc.), a communication interface 412 (e.g., Bluetooth interface, infrared interface, network interface, optical interface, etc.), and numerous other elements and functionalities.

The computer processor(s) 402 may be an integrated circuit for processing instructions. For example, the computer processor(s) may be one or more cores or micro-cores of a processor. The computing system 400 may also include one or more input devices 410, such as a touchscreen, keyboard, mouse, microphone, touchpad, electronic pen, or any other type of input device.

The communication interface 412 may include an integrated circuit for connecting the computing system 400 to a network (not shown) (e.g., a local area network (LAN), a wide area network (WAN) such as the Internet, mobile network, or any other type of network) and/or to another device, such as another computing device.

Further, the computing system 400 may include one or more output devices 408, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 402, non-persistent storage 404, and persistent storage 406. Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure. The computing system 400 in FIG. 4 may be connected to or be a part of a network.

In one or more exemplary embodiments, the functions described may be implemented in hardware, software, firmware, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

While the present teachings have been illustrated with respect to one or more embodiments, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A well operation facility comprising:

a plurality of pumps, comprising:

a first pump configured to deliver mud and cement to a borehole;

a second pump configured to deliver mud to the borehole;

a third pump configured to deliver mud to the borehole;

an inlet manifold coupled to each of the plurality of pumps, wherein the inlet manifold is configured to deliver mud and/or cement to the plurality of pumps; and a first discharge manifold coupled to each of the plurality of pumps, wherein the first discharge manifold comprises manifold inlets, a manifold outlet, and intersecting fluid paths between the manifold inlets and the manifold outlet, wherein the manifold inlets are configured to receive flows of the mud and/or cement from respective pump outlets of the plurality of pumps, wherein the intersecting fluid paths are configured to route flows from the plurality of pumps to the manifold outlet to deliver a discharge flow at a pressure to a first line, wherein the first line is configured to extend from the manifold outlet of the first discharge manifold to the borehole;

wherein the plurality of pumps are configured to be isolated from each other and to be used in series, parallel or as backups to each other.

2. The well operation facility of claim 1, further comprising a mixing system configured to deliver at least one of a cement slurry, a mud, or water to the inlet manifold.

3. The well operation facility of claim 2, wherein the mixing system comprises at least one of a surge can, a mixer, a mix tub, a buffering tank, an overflow averaging tub, a mud tank, or a sifting mechanism.

4. The well operation facility of claim 2, further comprising a liquid additive system configured to deliver liquid additives to the mixing system and/or the inlet manifold.

5. The well operation facility of claim 1, further comprising a cleaning system configured to circulate a cleaning fluid through each of the plurality of pumps between a mud operation and a cementing operation, wherein the mud operation flows the mud through one or more of the plurality of pumps, wherein the cementing operation flows the cement through one or more of the plurality of pumps.

6. The well operation facility of claim 5, wherein the cleaning system is fluidly coupled to the intake manifold, and the cleaning fluid comprises water.

7. The well operation facility of claim 6, wherein a mixing system is fluidly coupled to the intake manifold, the mixing system is disposed between the cleaning system and the intake manifold, and the mixing system is configured to selectively supply the cement and the mud to the intake manifold.

8. The well operation facility of claim 2, further comprising a bulk storage system configured to deliver a product to the mixing system.

9. The well operation facility of claim 1, further comprising a second discharge manifold coupled to each of the plurality of pumps, wherein:

the first discharge manifold is configured to deliver the cement to the first line comprising a rig cementing line, and the second discharge manifold is configured to deliver the mud to a second line comprising a rig mud line.

10. The well operation facility of claim 1, wherein the first pump is a plunger style pump.

11. A method of delivering a fluid to a borehole, the method comprising:

pumping, via a first pump, a first flow of a first material comprising one of mud or cement to the borehole at a first discharge pressure;

circulating a cleaning flow of water through the first pump to clean the first material from the first pump after pumping the first flow of the first material; and pumping, via the first pump, a second flow of a second material comprising the other of mud or cement to the borehole at a second discharge pressure after circulating the cleaning flow to clean the first material from the first pump.

12. The method of claim 11, further comprising mixing the first material comprising the one of mud or cement in a mixing assembly.

13. The method of claim 12, further comprising mixing the second material comprising the other of mud or cement in the mixing assembly.

14. The method of claim 11, further comprising isolating the first pump from the first material prior to circulating the cleaning flow of water through the first pump.

15. The method of claim 11, further comprising isolating the first pump from the water after circulating the cleaning flow of water through the first pump and prior to pumping, via the first pump, the second flow of the second material.

16. The method of claim 11, wherein pumping the first and second flows comprises operating the first pump and a second pump in series.

17. The method of claim 16, wherein the first and second pumps in series are not the same.

18. The method of claim 11, further comprising controlling a distribution of flows discharged from a plurality of pumps including the first pump with a first discharge manifold and a second discharge manifold, wherein the first discharge manifold comprises a first outlet coupled to a first line configured to deliver the first material, wherein the second discharge manifold comprises a second outlet coupled to a second line configured to deliver the second material.

19. The method of claim 11, comprising controlling a distribution of flows received into the plurality of pumps via an inlet manifold, wherein the inlet manifold is configured to receive and distribute the first material, the water, and the second material to the plurality of pumps.

20. The method of claim 11, further comprising controlling a distribution of flows discharged from the first pump, a second pump, and a third pump with a first discharge manifold, wherein the first discharge manifold comprises a first inlet coupled to the first pump, a second inlet coupled to the second pump, a third inlet coupled to the third pump, and a first outlet coupled to a first line, wherein the first line is configured to couple to the borehole.

21. The method of claim 11, comprising controlling one or more valves to control mutual exclusive intake of the first material, the water, and the second material into the first pump, wherein the first material, the water, and the second material pass through a common portion of the first pump when pumping the first flow of the first material, circulating the cleaning flow of water, and pumping the second flow of the second material, respectively.

* * * * *